US009055654B2

(12) United States Patent
Yamazaki et al.

(10) Patent No.: US 9,055,654 B2
(45) Date of Patent: Jun. 9, 2015

(54) FILM FORMATION APPARATUS AND FILM FORMATION METHOD

(71) Applicant: Semiconductor Energy Laboratory Co., Ltd., Kanagawa-ken (JP)

(72) Inventors: Shunpei Yamazaki, Tokyo (JP); Shingo Eguchi, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 220 days.

(21) Appl. No.: 13/716,113

(22) Filed: Dec. 15, 2012

(65) Prior Publication Data

US 2013/0164437 A1 Jun. 27, 2013

(30) Foreign Application Priority Data

Dec. 22, 2011 (JP) ..... 2011-280793

(51) Int. Cl.
*H05B 33/10* (2006.01)

(52) U.S. Cl.
CPC ..... *H05B 33/10* (2013.01)

(58) Field of Classification Search
CPC ..... H05B 33/10
USPC ..... 427/427.3; 137/427.3
See application file for complete search history.

(56) References Cited

U.S. PATENT DOCUMENTS

| | | | | |
|---|---|---|---|---|
| 6,739,931 | B2 | 5/2004 | Yamazaki et al. | |
| 7,166,006 | B2 * | 1/2007 | Cok | 445/14 |
| 7,211,461 | B2 | 5/2007 | Sakata et al. | |
| 7,309,269 | B2 | 12/2007 | Yamazaki et al. | |
| 7,368,307 | B2 | 5/2008 | Cok | |
| 7,943,443 | B2 | 5/2011 | Yamazaki et al. | |
| 7,948,171 | B2 | 5/2011 | Sakakura et al. | |
| 8,034,182 | B2 | 10/2011 | Yamazaki et al. | |
| 8,119,189 | B2 | 2/2012 | Yamazaki et al. | |
| 8,206,507 | B2 | 6/2012 | Yamazaki et al. | |
| 2003/0221620 | A1 | 12/2003 | Yamazaki | |
| 2004/0017408 | A1 * | 1/2004 | Cok | 347/5 |
| 2009/0074952 | A1 | 3/2009 | Yamazaki et al. | |

FOREIGN PATENT DOCUMENTS

JP 2004-43965 2/2004

* cited by examiner

*Primary Examiner* — Nathan T Leong
(74) *Attorney, Agent, or Firm* — Husch Blackwell LLP

(57) ABSTRACT

A film formation apparatus with which a deposited film to cover a deposition object having a three-dimensional curved surface can be formed and a method of forming a deposited film to cover a three-dimensional curved surface. The film formation apparatus includes a deposition source having deposition directivity, a deposition-source-moving mechanism which moves the deposition source, a deposition-object-holding mechanism which holds a deposition object having a three-dimensional curved surface, a deposition-direction-changing mechanism which changes the deposition direction, and a control portion which controls the deposition-source-moving mechanism and the deposition-direction-changing mechanism.

9 Claims, 5 Drawing Sheets

FILM FORMATION APPARATUS AND FILM FORMATION METHOD

BACKGROUND OF THE INVENTION

1. Field of the Invention

The present invention relates to a film formation apparatus and a film formation method using a deposition source having a deposition direction with directivity.

2. Description of the Related Art

A technique of forming a deposited film on a flat substrate is known. For example, Patent Document 1 describes an apparatus for forming a deposited film while moving a deposition source holder.

A light-emitting element (also referred to as an EL element) in which a layer containing a light-emitting organic compound (also referred to as an EL layer) is provided between a pair of electrodes is known. Upon application of a voltage between the pair of electrodes of a light-emitting element, light emission can be obtained from the light-emitting organic compound. Such EL elements can be used in light-emitting devices for display devices, lighting devices, and the like. Many of already-known EL elements have a planar shape and include a layer containing a light-emitting organic compound formed on an electrode on a flat substrate by an evaporation method.

REFERENCE

Patent Document 1: Japanese Published Patent Application No. 2004-43965

SUMMARY OF THE INVENTION

Since a deposition source of a film formation apparatus has directivity, it has been impossible to form a deposited film to cover a deposition object having a deposition surface facing the deposition direction of the fixed deposition source at various angles (in this specification, such a deposition object is referred to as a deposition object having a three-dimensional curved surface. The term three-dimensional curved surface refers to a flat surface, a combination of a plurality of flat surfaces, and a combination of a flat surface and a curved surface). For example, on a portion of the deposition surface perpendicular to the deposition direction of the fixed deposition source, a thick film is formed in a narrow region; on a portion of the deposition surface tilted with respect to the deposition source, a thin film is formed in a wide region. This is because the area of a region of the deposition surface, which crosses vapor emitted from the deposition source, changes depending on the distance between the deposition source and the deposition surface or on the angle formed by the deposition direction with the deposition surface.

One embodiment of the present invention is made in view of the foregoing technical background. An object is to provide a film formation apparatus with which a deposited film to cover a deposition object having a three-dimensional curved surface can be formed. Another object is to provide a method of forming a deposited film to cover a three-dimensional curved surface.

To achieve any of the above objects, one embodiment of the present invention is devised focusing on the following points: the first is the directivity of the deposition direction of a deposition source; the second is the speed of movement of the deposition source relative to a deposition object; the third is the distance between the deposition object and the deposition source; and the fourth is the angle formed by the deposition surface with the deposition direction of the deposition source. Consequently, the inventors have reached the idea of a film formation apparatus and a film formation method having a structure exemplified in this specification.

Specifically, one embodiment of the present invention is a film formation apparatus including: a deposition source having a deposition direction with directivity; a deposition-source-moving mechanism configured to move the deposition source; a deposition-object-holding mechanism configured to hold a deposition object having a three-dimensional curved surface; a deposition-direction-changing mechanism configured to change the deposition direction of the deposition source; and a control portion configured to control the deposition-source-moving mechanism and the deposition-direction-changing mechanism, whereby a deposited film is formed on the three-dimensional curved surface of the deposition object.

One embodiment of the present invention is a film formation apparatus including: a deposition source having a deposition direction with directivity; a deposition-source-moving mechanism configured to move the deposition source; a deposition-object-holding mechanism configured to hold a deposition object having a three-dimensional curved surface; a deposition-object-holding-angle-changing mechanism configured to change a holding angle of the deposition object so that an angle formed by a deposition surface of the deposition object with a deposition direction can be maintained constant; and a control portion configured to control the deposition-source-moving mechanism and the deposition-object-holding-angle-changing mechanism, whereby a deposited film is formed on the three-dimensional curved surface of the deposition object.

One embodiment of the present invention is a film formation apparatus including: a deposition source having a deposition direction with directivity; a deposition-source-moving mechanism configured to move the deposition source; a deposition-object-holding mechanism configured to hold a deposition object having a three-dimensional curved surface; a deposition-direction-changing mechanism configured to change the deposition direction of the deposition source; a deposition-object-holding-angle-changing mechanism configured to change a holding angle of the deposition object so that an angle formed by a deposition surface of the deposition object with the deposition direction can be maintained constant; and a control portion configured to control the deposition-source-moving mechanism, the deposition-direction-changing mechanism, and the deposition-object-holding-angle-changing mechanism, whereby a deposited film is formed on the three-dimensional curved surface of the deposition object.

In any of the above film formation apparatuses of embodiments of the present invention, the deposition source can be moved in accordance with the shape of the deposition surface. In addition, the angle formed by the deposition object with the deposition direction can be changed. Accordingly, the angle formed by the deposition surface of the deposition object with the deposition direction can be maintained constant. Further, the distance between the deposition source and the deposition surface can be maintained constant. Thus, a film formation apparatus with which a deposited film to cover a three-dimensional curved surface can be formed can be provided.

One embodiment of the present invention is a film formation method by which a first belt-shaped deposited layer is formed on a part of a deposition surface of a deposition object while a deposition source having directivity is moved, and a second belt-shaped deposited layer is formed so as not to overlap with the first belt-shaped deposited layer. In the film formation method in accordance with one embodiment of the present invention, the deposition direction of the deposition source and/or a holding angle of the deposition object is/are changed, so that the angle formed by the deposition surface of the deposition object with the deposition direction is maintained constant.

In the above film formation method of one embodiment of the present invention, the deposition direction and/or the holding angle of the deposition object is/are changed in accordance with the angle formed by the deposition surface of the deposition object. Hence, the plurality of belt-shaped deposited layers can cover a three-dimensional curved surface regardless of the shape of the surface. Thus, a method of forming a deposited film to cover the whole or part of a three-dimensional curved surface can be provided.

One embodiment of the present invention is a film formation method by which a first belt-shaped deposited layer is formed on a part of a deposition surface of a deposition object while a deposition source having directivity is moved, and a second belt-shaped deposited layer is formed so as not to overlap with the first belt-shaped deposited layer. In the film formation method in accordance with one embodiment of the present invention, the deposition direction of the deposition source and/or a holding angle of the deposition object is/are changed, so that the angle formed by the deposition surface of the deposition object with the deposition direction is maintained constant and the distance between the deposition source and the deposition surface is maintained constant.

In the above film formation method of one embodiment of the present invention, the deposition direction and/or the holding angle of the deposition object is/are changed in accordance with the angle formed by the deposition surface of the deposition object. Hence, the plurality of belt-shaped deposited layers having uniform thicknesses can cover a three-dimensional curved surface regardless of the shape of the surface. Thus, a method of forming a deposited film to cover a three-dimensional curved surface can be provided.

One embodiment of the present invention is a film formation method by which a first belt-shaped deposited layer is formed on a part of a deposition surface of a deposition object while a deposition source having directivity is moved, and a second belt-shaped deposited layer is formed so as not to overlap with the first belt-shaped deposited layer. The film formation method includes a step of depositing the belt-shaped layer on the deposition surface of the deposition object perpendicular to a deposition direction while moving the deposition source at a first speed, and a step of depositing the belt-shaped layer on the deposition surface of the deposition object tilted with respect to the deposition direction while moving the deposition source at a second speed. In the film formation method, the first speed is higher than the second speed.

In the above film formation method of one embodiment of the present invention, the speed of movement of the deposition source is changed in accordance with the angle formed by the deposition surface of the deposition object with, the deposition direction. At a uniform speed of movement of the deposition source; on the deposition surface of the deposition object perpendicular to the deposition direction, a thicker film tends to be formed than on the deposition surface tilted with respect to the deposition direction. Therefore the deposition source is moved at a higher speed during deposition on the deposition surface perpendicular to the deposition direction, whereas the deposition source is moved at a lower speed during deposition on the deposition surface tilted with respect to the deposition direction. Thus, a method of forming a deposited film to cover a three-dimensional curved surface can be provided.

Note that in this specification, the term EL layer refers to a layer provided between a pair of electrodes in a light-emitting element. Thus, a light-emitting layer including an organic compound that is a light-emitting substance which is interposed between electrodes is one mode of the EL layer.

In this specification, in the case where a substance A is dispersed in a matrix formed with a substance B, the substance B forming the matrix is referred to as a host material, and the substance A dispersed in the matrix is referred to as a guest material. Note that the substance A and the substance B may each be a single substance or a mixture of two or more kinds of substances.

Note that the term light-emitting device in this specification refers to an image display device, a light-emitting device, or a light source (including a lighting device). The light-emitting device includes any of the following modules in its category: a module in which a connector such as an FPC (flexible printed circuit), a TAB (tape automated bonding) tape, or a TCP (tape carrier package) is attached to a light-emitting device; a module having a TAB tape or a TCP provided with a printed wiring board at the end thereof; and a module having an IC (integrated circuit) directly mounted over a substrate over which a light-emitting element is formed by a COG (chip on glass) method.

In accordance with one embodiment of the present invention, a film formation apparatus with which a deposited film to cover a deposition object having a three-dimensional curved surface can be formed can be provided. Alternatively, a method of forming a deposited film to cover a three-dimensional curved surface can be provided.

DETAILED DESCRIPTION OF THE INVENTION

Figure 1A:
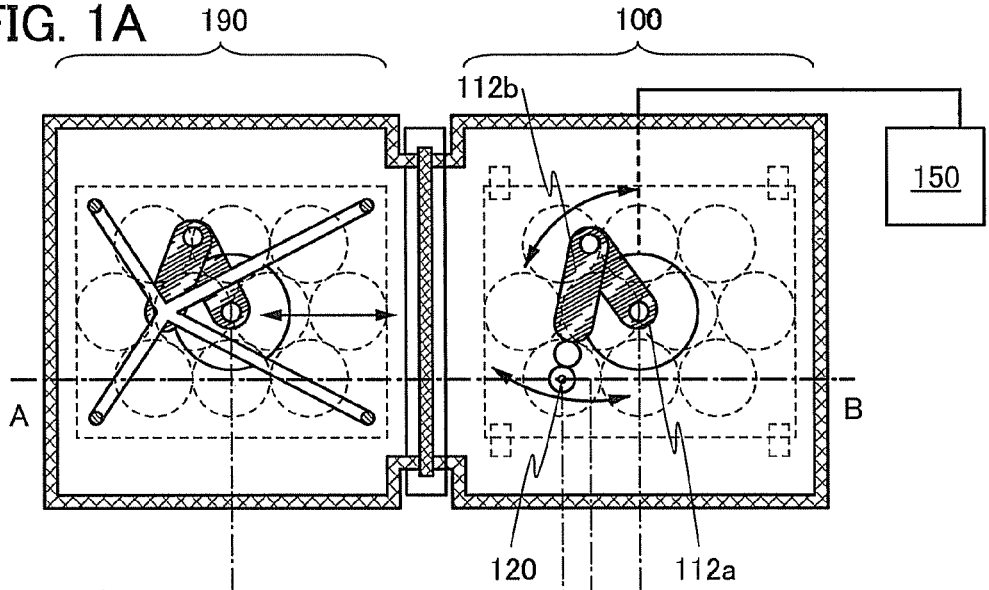
FIGS. 1A to 1D illustrate a film formation apparatus in accordance with one embodiment.

Embodiments will be described in detail with reference to the drawings. Note that the present invention is not limited to the following description. It will be easily understood by those skilled in the art that modes and details thereof can be variously changed without departing from the spirit and the scope of the present invention. Therefore, the present invention should not be construed as being limited to the description in the following embodiments. Note that in the structures of the invention described below, the same portions or portions having similar functions are denoted by the same reference numerals in different drawings, and description of such portions, is not repeated.

Embodiment 1

This embodiment describes a structure of a film formation apparatus of one embodiment of the present invention with reference to FIGS. 1A to 1D. Specifically, the film formation apparatus includes a deposition source having a deposition direction with directivity, a deposition-source-moving mechanism which moves the deposition source, a deposition-object-holding mechanism which holds a deposition object having a three-dimensional curved surface, a deposition-direction-changing mechanism which changes the deposition direction of the deposition source, a deposition-object-holding-angle-changing mechanism which changes a holding angle of the deposition object so that the angle formed by a deposition surface of the deposition object with the deposition direction can be maintained constant, and a control portion which controls the deposition-source-moving mechanism, the deposition-direction-changing mechanism, and the deposition-object-holding-angle-changing mechanism so that a deposited film can be formed on the three-dimensional curved surface of the deposition object.

In any of the above film formation apparatuses of embodiments of the present invention, the deposition source can be moved in accordance with the shape of the deposition surface. In addition, the angle formed by the deposition object with the deposition direction can be changed. Accordingly, the angle fainted by the deposition surface of the deposition object with the deposition direction can be maintained constant. Further, the distance between the deposition source and the deposition surface can be maintained constant. Thus, a film formation apparatus with which a deposited film to cover a three-dimensional curved surface can be formed can be provided.

Figure 1B:
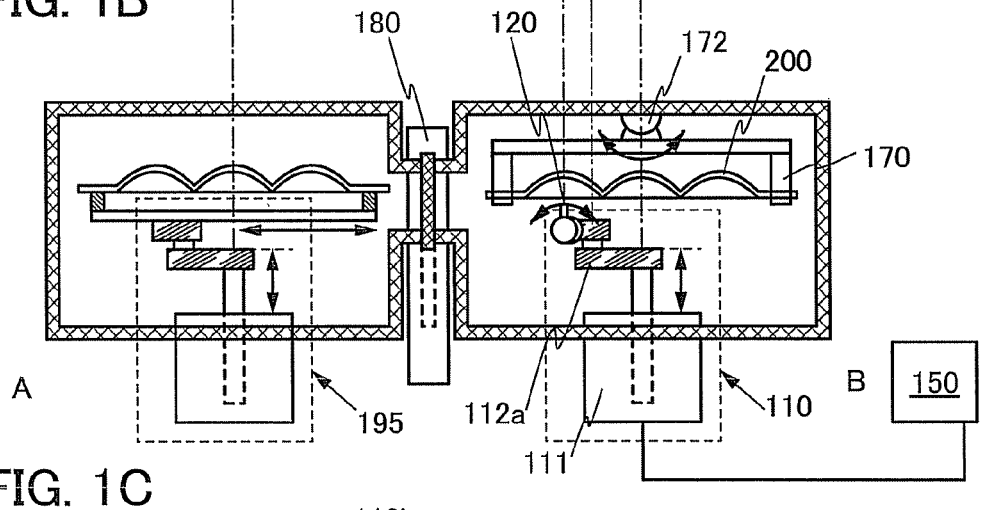
Figure 1C:
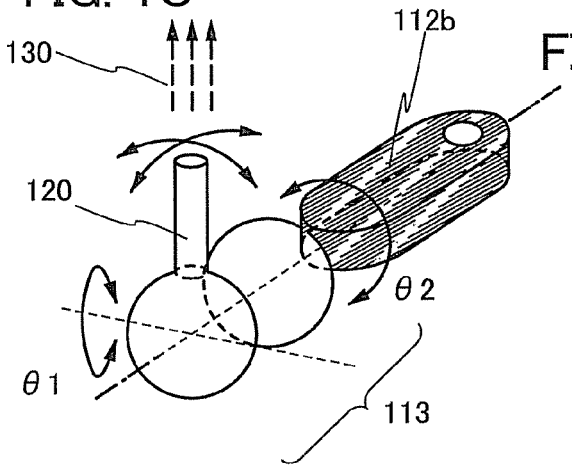

FIG. 1A is a top view of the film formation apparatus of one embodiment of the present invention. FIG. 1B is a cross-sectional view along the cutting plane line A-B in FIG. 1A, which illustrates an inner structure. FIG. 1C is a perspective view illustrating details of the deposition-direction-changing mechanism.

A film formation apparatus 100 exemplified in FIGS. 1A to 1D includes a deposition source 120 having a deposition direction with directivity, a deposition-source-moving mechanism 110 which moves the deposition source 120, a deposition-object-holding mechanism 170 which holds a deposition object 200 having a three-dimensional curved surface, a deposition-direction-changing mechanism 113 which changes the deposition direction of the deposition source 120, a deposition-object-holding-angle-changing mechanism 172 which changes the angle formed by the deposition surface of the deposition object with the deposition direction, and a control portion 150 which controls the deposition-source-moving mechanism 110, the deposition-direction-changing mechanism 113, and the deposition-object-holding-angle-changing mechanism 172 so that a deposited film can be formed on the three-dimensional curved surface of the deposition object 200.

Further, the film formation apparatus 100 exemplified in this embodiment is connected to a transfer chamber 190 through a gate valve 180. The transfer chamber 190 includes a transfer mechanism 195. The transfer mechanism 195 supplies the deposition object 200 to the film formation apparatus 100 and withdraws the deposition object 200 from the film formation apparatus 100. For convenience of explanation, FIG. 1A illustrates the state where the deposition object 200 is put inside the film formation apparatus 100 and the transfer chamber 190 at the same time.

Note that the film for apparatus 100 and the transfer chamber 190 are each connected to an exhaust system not shown in the figure. The film formation apparatus 100 or the transfer chamber 190 may be connected to another apparatus not shown in the figure.

The following describes individual components included in the film formation apparatus of one embodiment of the present invention.

Deposition Object

A mode of the deposition object 200 exemplified in this embodiment is described. The deposition surface of the deposition object 200 has a plurality of concaves. The profile of each concave is a circle, and each cross section along the line connecting two positions in the periphery of the concave through its center gently forms an arc. However, such a shape is an example of the deposition object having a surface on which a deposited film can be formed with the film formation apparatus of one embodiment of the present invention. The deposition surface may have a convex shape. When the deposition surface has a concave, the concave has a space large enough to allow the deposition source to operate (e.g., move, change in direction, or deposition). Note that three-dimensional curved surface refers to a flat surface, a combination of a plurality of flat surfaces, and a combination of a flat surface and a curved surface.

Deposition Source Having Deposition Direction with Directivity

The deposition source 120 which can be used for one embodiment of the present invention has a deposition direction with directivity. For example, the deposition source 120 illustrated in FIG. 1C emits vapor 130 including a deposition substance in the direction of the dashed arrows.

As the deposition source 120, a point cell type deposition source, a valved cell type deposition source, or the like can be used, for example.

Deposition-Source-Moving Mechanism

The deposition-source-moving mechanism 110 moves the deposition source 120 to any position on a plane overlapping with the deposition surface of the deposition object 200. The deposition-source-moving mechanism 110 also moves the deposition source 120 in the direction of the axis across the plane.

The deposition-source-moving mechanism 110 exemplified in this embodiment employs a multi-axis robot. The exemplified multi-axis robot includes a base unit 111, a first arm 112*a*, and a second arm 112*b*. One end portion of the first arm 112*a* is attached to the base unit 111 and is rotatable. One end portion of the second arm 112*b* is attached to the other end portion of the first arm 112*a* and is rotatable. The deposition-direction-changing mechanism 113 is attached to the other end portion of the second arm 112*b*. Note that the base unit 111 can vertically move the first arm 112*a*, the second arm 112*b*, and the deposition source 120.

The first arm 112*a* and the second arm 112*b* move the deposition source 120 to any position on a plane overlapping with the deposition surface of the deposition object 200. The base unit 111 moves the deposition source 120 in the direction of the axis across the plane. Note that the speed at which the deposition-source-moving mechanism 110 moves the deposition source 120 either along or across the plane can be changed and the speed may be determined by the control portion 150.

Figure 1D:
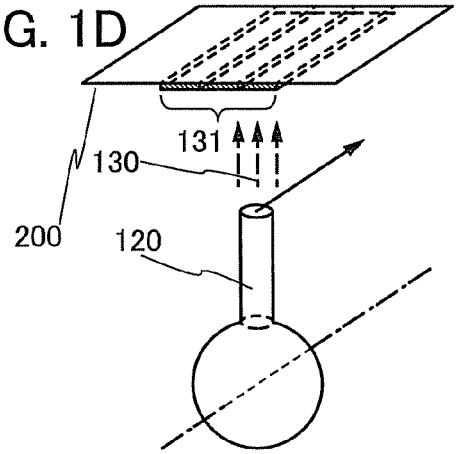

FIG. 1D depicts the state where the vapor emitted from the deposition source 120 moved by the deposition-source-moving mechanism 110 is applied to the deposition surface of the deposition object 200. A plurality of belt-shaped deposited layers is formed so as not to overlap with each other, thereby forming a deposited film 131.

Further, the deposition-source-moving mechanism 110 can change the distance between the deposition object 200 and the deposition source 120.

In addition, the deposition-source-moving mechanism 110 may be provided with a sensor which detects the distance between the deposition object 200 and the deposition source 120. Such a sensor allows accurate control of the distance between the deposition object 200 and the deposition source 120, leading to a film formation apparatus with which a deposited film having a uniform thickness can be formed on a three-dimensional curved surface.

Deposition-Direction-Changing Mechanism

The deposition-direction-changing mechanism 113 changes the deposition direction of the deposition source 120 having directivity.

As illustrated in FIG. 1C, the deposition-direction-changing mechanism 113 exemplified in this embodiment changes the deposition direction of the deposition source 120 having directivity, around two rotation axes which cross each other. Specifically, rotation is possible as denoted by either θ1 or θ2, the axis of which is orthogonal to the axis of θ1. With such a mechanism enabling changes along the two crossing axes, the deposition direction of the deposition source 120 can form any angle with the deposition surface.

Deposition-Object-Holding Mechanism

The deposition-object-holding mechanism 170 holds the deposition surface of the deposition object 200 facing the deposition source 120.

Deposition-Object-Holding-Angle-Changing Mechanism

The deposition-object-holding-angle-changing mechanism 172 controls the angle formed by the deposition surface of the deposition object 200 with the deposition direction of the deposition source 120. Note that although an arrow in FIG. 1B indicates that the angle can be changed in the horizontal direction, the angle can also be changed in the forward and backward directions of the figure. With such a mechanism enabling changes along the two crossing axes, the deposition surface can form any angle with the deposition direction of the deposition source 120.

Control Portion

The control portion 150 controls the deposition-source-moving mechanism 110 to control the position and speed of movement of the deposition source 120. The control portion 150 also controls the deposition-direction-changing mechanism 113 to control the deposition direction of the deposition source 120 having directivity. Further, the control portion 150 controls the deposition-object-holding-angle-changing mechanism 172 to control the angle formed by the deposition surface of the deposition object with the deposition direction of the deposition source 120. Note that the control portion can store data of the shape of the deposition object and, on the basis of this data, the control portion can control the position or speed of movement of the deposition source or the holding angle of the deposition object, for example.

Modification Example 1

A film formation apparatus in accordance with Modification Example 1 in this embodiment has a structure in which the deposition-object-holding-angle-changing mechanism 172 which changes the angle formed by the deposition surface of the deposition object with the deposition direction is removed from the film formation apparatus 100 exemplified in this embodiment.

In other words, the film formation apparatus includes a deposition source having a deposition direction with directivity, a deposition-source-moving mechanism configured to move the deposition source, a deposition-object-holding mechanism configured to hold a deposition object having a three-dimensional curved surface, a deposition-direction-changing mechanism configured to change the deposition direction of the deposition source, and a control portion configured to control the deposition-source-moving mechanism and the deposition-direction-changing mechanism, whereby a deposited film is formed on the three-dimensional curved surface of the deposition object.

In the film formation apparatus in accordance with Modification Example 1, the deposition source can be moved in accordance with the shape of the deposition surface. In addition, the angle formed by the deposition object with the deposition direction can be changed. Accordingly, the angle formed by the deposition surface of the deposition object with the deposition direction can be maintained constant. Further, the distance between the deposition source and the deposition surface can be maintained constant. Thus, a film formation apparatus with which a deposited film to cover a three-dimensional curved surface can be formed can be provided.

Modification Example 2

A film formation apparatus in accordance with Modification Example 2 in this embodiment has a structure in which the deposition-direction-changing mechanism 113 which changes the deposition direction of the deposition source is removed from the film formation apparatus 100 exemplified in this embodiment.

That is, the a film formation apparatus includes: a deposition source having a deposition direction with directivity; a deposition-source-moving mechanism configured to move the deposition source; a deposition-object-holding mechanism configured to hold a deposition object having a three-dimensional curved surface; a deposition-object-holding-angle-changing mechanism configured to change a holding angle of the deposition object so that an angle formed by a deposition surface of the deposition object with a deposition direction can be maintained constant; and a control portion configured to control the deposition-source-moving mechanism and the deposition-object-holding-angle-changing mechanism, whereby a deposited film is formed on the three-dimensional curved surface of the deposition object.

In, the film formation apparatus in accordance with Modification Example 2, the deposition source can be moved in accordance with the shape of the deposition surface. In addition, the angle formed by the deposition object with the deposition direction can be changed. Accordingly, the angle formed by the deposition surface of the deposition object with the deposition direction can be maintained constant. Further, the distance between the deposition source and the deposition surface can be maintained constant. Thus, a film formation apparatus with which a deposited film to cover a three-dimensional curved surface can be formed can be provided.

This embodiment can be combined as, appropriate with any of the other embodiments described in this specification.

Embodiment 2

In this embodiment, a film formation method of one embodiment of the present invention is described with reference to FIG. 2A. Specifically described is a film formation method by which a first belt-shaped deposited layer is formed in a region of a deposition surface of a deposition object while a deposition source having directivity is moved, and a second belt-shaped deposited layer is formed so as not to overlap with the first belt-shaped deposited layer. In the film formation method, the deposition direction of the deposition source and a holding angle of the deposition object are changed, so that the angle formed by the deposition surface of the deposition object with the deposition direction is maintained constant.

In the film formation method exemplified in this embodiment, the deposition direction and the holding angle of the deposition object are changed in accordance with the angle formed by the deposition surface of the deposition object. Hence, the plurality of belt-shaped deposited layers can cover a three-dimensional curved surface regardless of the shape of the surface. Thus, a method of forming a deposited film to cover the whole or part of a three-dimensional curved surface can be provided.

Figure 2A:
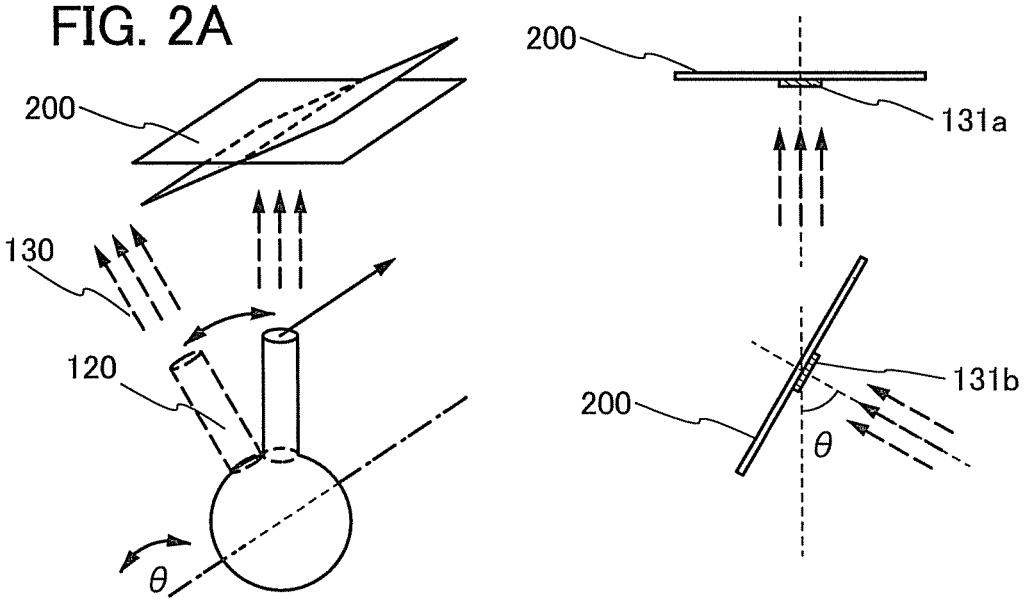
FIGS. 2A and 2B illustrate deposition sources having a deposition direction with directivity in accordance with one embodiment.

FIG. 2A illustrates the state where the angle between the deposition surface of the deposition object 200 and the deposition direction of the deposition source 120 is maintained constant. In the figure, the direction in which the deposition source 120 emits the vapor 130 including a deposition substance is indicated by the broken-line arrows.

At the upper right corner of FIG. 2A, the deposition source is placed so that the deposition direction is the same as the direction vertical to the deposition surface of the horizontally placed deposition object 200. It can also be seen that the vapor emitted from the deposition source is applied to the deposition surface while the deposition source 120 is moved in the forward and backward directions of the figure, so that a belt-shaped deposited layer 131*a* is formed.

At the lower right corner of FIG. 2A, the deposition source is placed so that the deposition direction is the same as the direction perpendicular to the deposition surface of the tilted deposition object 200. It can also be seen that the vapor emitted from the deposition source is applied to the deposition surface while the deposition source 120 is moved in the forward and backward directions of the figure, so that a belt-shaped deposited layer 131*b* is formed.

The deposition direction and the holding angle of the deposition object are changed in accordance with the angle formed by the deposition surface of the deposition object, so that a belt-shaped deposited layer can be formed on the three-dimensional curved surface, like the belt-shaped deposited layers 131*a* and 131*b* illustrated in FIG. 2A. A plurality of belt-shaped deposited layers provided so as not to overlap with each other can cover the whole or part of the three-dimensional curved surface.

Modification Example 1

A film formation method in accordance with Modification Example 1 in this embodiment is an example of the film formation method exemplified in this embodiment, in which only the deposition direction of the deposition source is changed so that the angle formed by the deposition surface of the deposition object with the deposition direction is maintained constant. Hence, the plurality of belt-shaped deposited layers can cover a three-dimensional curved surface regardless of the shape of the surface. Thus, a method of forming a deposited film to cover a three-dimensional curved surface can be provided. Further, the structure of the film formation apparatus can be simplified because the control portion does not need to control the deposition-object-holding-angle-changing mechanism.

Modification Example 2

A film formation method in accordance with Modification Example 2 in this embodiment is an example of the film formation method exemplified in this embodiment, in which only the holding angle of the deposition object is changed so that the angle formed by the deposition surface of the deposition object with the deposition direction is maintained constant. Hence, the plurality of belt-shaped deposited layers can cover a three-dimensional curved surface regardless of the shape of the surface. Thus, a method of forming a deposited film to cover the whole or part of a three-dimensional curved surface can be provided. Further, the structure of the film formation apparatus can be simplified because the control portion does not need to control the deposition-direction-changing mechanism.

This embodiment can be combined as appropriate with any of the other embodiments described in this specification.

Embodiment 3

In this embodiment, a film formation method of one embodiment of the present invention is described. The film formation method exemplified in this embodiment is a method by which a first belt-shaped deposited layer is formed in a region of a deposition surface of a deposition object while a deposition source having directivity is moved, and a second belt-shaped deposited layer is formed so as not to overlap with the first belt-shaped deposited layer. In the film formation method, the deposition direction of the deposition source and a holding angle of the deposition object are changed, so that the angle formed by the deposition surface of the deposition object with the deposition direction is maintained constant and the distance between the deposition source and the deposition surface is maintained constant.

In the above film formation method of one embodiment of the present invention, the deposition direction and the holding angle of the deposition object are changed in accordance with the angle formed by the deposition surface of the deposition object. Hence, the plurality of belt-shaped deposited layers having uniform thicknesses can cover a three-dimensional curved surface regardless of the shape of the surface. Thus, a method of farming a deposited film to cover a three-dimensional curved surface can be provided.

Even in the case where the vapor from the deposition source is diffusively emitted through an evaporation inlet, the vapor can be made to uniformly spread over the deposition surface in accordance with the structure in which deposition is performed while maintaining the distance between the deposition source and the deposition surface constant. Consequently, the belt-shaped deposited layer, which is formed on the deposition object while the deposition source is moved, has a uniform width. Thus control of the movement of the deposition source is easy.

Modification Example 1

A film formation method in accordance with Modification Example 11n this embodiment is an example of the film formation method exemplified in this embodiment, in which only the deposition direction of the deposition source is changed so that the angle formed by the deposition surface of the deposition object with the deposition direction is maintained constant. Hence, the plurality of belt-shaped deposited layers having uniform thicknesses can cover a three-dimensional curved surface regardless of the shape of the surface. Thus, a method of forming a deposited film to cover a three-dimensional curved surface can be provided. Further, the structure of the film formation apparatus can be simplified because the control portion does not need to control the deposition-object-holding-angle-changing mechanism.

Even in the case where the vapor from the deposition source is diffusively emitted through an evaporation inlet, the vapor can be made to uniformly spread over the deposition surface in accordance with the structure in which deposition is performed while maintaining the distance between the deposition source and the deposition surface constant. Consequently, the belt-shaped deposited layer, which is formed on the deposition object while the deposition source is moved, has a uniform width. Thus control of the movement of the deposition source is easy.

Modification Example 2

A film formation method in accordance with Modification Example 2 in this embodiment is an example of the film formation method exemplified in this embodiment, in which only the holding angle of the deposition object is changed so that the angle limited by the deposition surface of the deposition object with the deposition direction is maintained constant. Hence, the plurality of belt-shaped deposited layers having uniform thicknesses can cover a three-dimensional curved surface regardless of the shape of the surface. Thus, a method of forming a deposited film to cover a three-dimensional curved surface can be provided. Further, the structure of the film formation apparatus can be simplified because the control portion does not need to control the deposition-direction-changing mechanism.

Even in the case where the vapor from the deposition source is diffusively emitted through an evaporation inlet, the vapor can be made to uniformly spread over the deposition surface in accordance with the structure in which deposition is performed while maintaining the distance between the deposition source and the deposition surface constant. Consequently, the belt-shaped deposited layer, which is formed on the deposition object while the deposition source is moved, has a uniform width. Thus control of the movement of the deposition source is easy.

This embodiment can be combined as appropriate with any of the other embodiments described in this specification.

Embodiment 4

In this embodiment, a film formation method of one embodiment of the present invention is described with reference to FIG. 2B. Specifically described is a film formation method by which a first belt-shaped deposited layer is formed in a region of a deposition surface of a deposition object while a deposition source having directivity is moved, and a second belt-shaped deposited layer is formed so as not to overlap with the first belt-shaped deposited layer. The film formation method includes a step of depositing a belt-shaped layer on the deposition surface of the deposition object perpendicular to a deposition direction while moving the deposition source at a first speed, and a step of depositing a belt-shaped layer on the deposition surface of the deposition object tilted with respect to the deposition direction while moving the deposition source at a second speed. In the film formation method, the first speed is higher than the second speed.

In the above film formation method of one embodiment of the present invention, the speed of movement of the deposition source can be changed in accordance with the angle formed by the deposition surface of the deposition object with the deposition direction. At a uniform speed of movement of the deposition source, on the deposition surface of the deposition object perpendicular to the deposition direction, a thicker film tends to be formed than on the deposition surface tilted with respect to the deposition direction. Therefore the deposition source is moved at a higher speed during deposition on the deposition surface perpendicular to the deposition direction, whereas the deposition source is moved at a lower speed during deposition on the deposition surface tilted with respect to the deposition direction. Thus, a method of forming a deposited film to cover a three-dimensional curved surface can be provided.

Figure 2B:
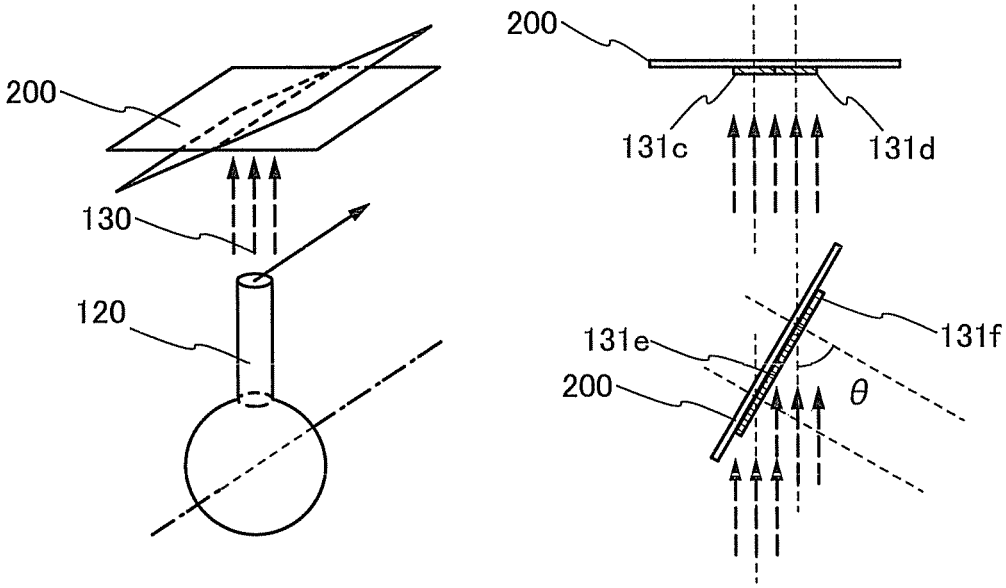

FIG. 2B illustrates the state where the deposition surface of the deposition object 200 is perpendicular to the deposition direction of the deposition source 120 and the state where the deposition surface of the deposition object 200 is tilted with respect to the deposition direction. In the figure, the direction in which the deposition source 120 emits the vapor 130 including a deposition substance is indicated by the broken-line arrows.

At the upper right corner of FIG. 2B illustrates the state where the vapor emitted from the deposition source, which is placed so that the deposition direction is vertical, is applied to the deposition surface of the horizontally placed deposition object 200, while the deposition source 120 is moved in the forward and backward directions of the figure. A belt-shaped deposited layer 131*c* is formed by first deposition in which the deposition source is moved. A belt-shaped deposited layer 131*d* is formed by second deposition in which the deposition source is moved. The belt-shaped deposited layers 131*c* and 131*d* have the same width and the same thickness.

At the lower right corner of FIG. 2B illustrates the state where the vapor emitted from the deposition source, which is placed so that the deposition direction is vertical, is applied to the deposition surface of the tilted deposition object 200, while the deposition source 120 is moved in the forward and backward directions of the figure. A belt-shaped deposited layer 131*e* is formed by first deposition in which the deposition source is moved. A belt-shaped deposited layer 131*f* is formed by second deposition in which the deposition source is moved. The belt-shaped deposited layers 131*e* and 131*f* have the same width and the same thickness.

However, the width of the belt-shaped deposited layer 131*e* becomes larger than that of the belt-shaped deposited layer 131*c*, and therefore the deposition of the belt-shaped deposited layer 131*e* takes longer. Hence, the deposition source is moved at a higher speed in deposition on the deposition surface perpendicular to the deposition direction, whereas the deposition source is moved at a lower speed in deposition onto a deposition surface tilted with respect to the deposition direction; thus, the deposition speed of the belt-shaped deposited layers can be maintained constant. Hence, the plurality of belt-shaped deposited layers can cover a three-dimensional curved surface regardless of the shape of the surface. Therefore control of the movement of the deposition source is easy.

This embodiment makes a comparison between the deposition surface perpendicular to the deposition direction and the deposition surface tilted with respect to the deposition direction for easier understanding, but does not limit the present invention. That is, as the tilt of the deposition surface to the deposition direction is larger and a deposited film formed by one-time movement of the deposition source becomes wider, the speed of movement of the deposition source is made lower.

This embodiment can be combined as appropriate with any of the other embodiments described in this specification.

Embodiment 5

This embodiment describes a structure of a light-emitting device including a deposited film to cover a three-dimensional curved surface formed using a film formation apparatus and a film formation method in accordance with one embodiment of the present invention, with reference to FIGS.

3A to 3C. Specifically, the light-emitting device includes a substrate having a three-dimensional curved surface, a barrier layer formed along one side of the substrate, a light-emitting element formed along the barrier layer, and a sealing material for sealing the light-emitting element with the substrate having a three-dimensional curved surface. The light-emitting element includes a first electrode over the barrier layer, a second electrode over the first electrode, and a layer including a light-emitting organic compound between the first electrode and the second electrode.

The above light-emitting device of one embodiment of the present invention includes the three-dimensional curved surface. Thus a light-emitting device including a three-dimensional curved surface which can be incorporated into a variety of devices having a three-dimensional curved surface can be provided.

Figure 3A:
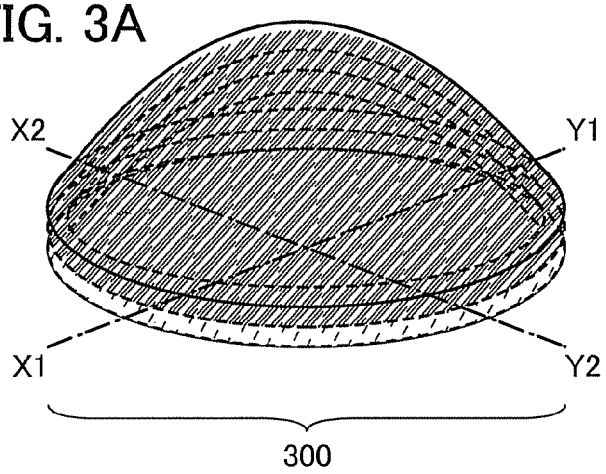
FIGS. 3A to 3C illustrate light-emitting devices in accordance with one embodiment of the present invention.
Figure 3B:
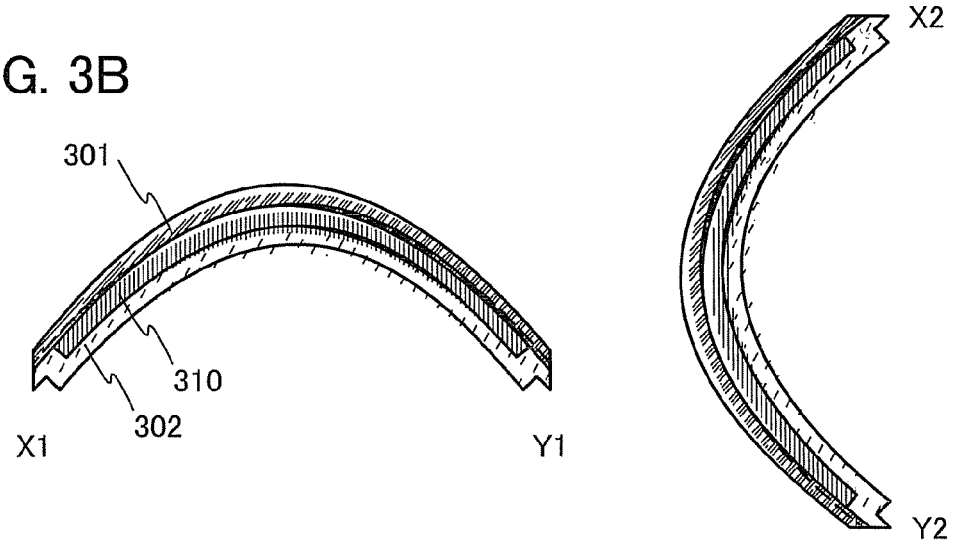
Figure 3C:
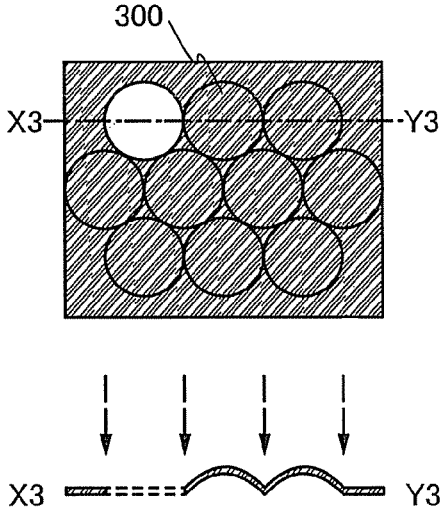

FIG. 3A illustrates a perspective view of a light-emitting device 300 of one embodiment of the present invention. FIG. 3B illustrates, on the left side, a cross section along the cutting plane line X1-Y1 in FIG. 3A and, on the right side, a cross section along the cutting plane line X2-Y2 in FIG. 3A. FIG. 3C illustrates a top view of the substrate provided with a plurality of light-emitting devices 300 and its cross section taken along the cutting plane line X3-Y3. In FIG. 3C, a white circle portion corresponds to a portion from which one light-emitting device 300 is cut out.

The light-emitting device 300 exemplified in FIG. 3A includes a substrate 301 having a three-dimensional curved surface, a barrier layer formed along one side of the substrate 301, a light-emitting element 310 formed along the barrier layer, and a sealing material 302 for sealing the light-emitting element 310 with the substrate 301 having a three-dimensional curved surface. The light-emitting element includes a first electrode over the barrier layer, a second electrode over the first electrode, and a layer including a light-emitting organic compound between the first electrode and the second electrode.

The sealing material 302 covers the edge portion of the light-emitting element 310 and is in contact with the substrate 301. The sealing material 302 is provided so as to prevent the edge portion of the light-emitting element 310 from being exposed at edge portion of the light-emitting device 300 because dispersion of into impurities such as water the light-emitting element 310 lowers the reliability of the light-emitting device 300.

The following describes individual components included in the light-emitting device of one embodiment of the present invention.

Substrate Having Three-Dimensional Curved Surface

The substrate 301 has a three-dimensional curved surface. The substrate 301 having a three-dimensional curved surface may be formed in such a way that, for example, a metal substrate is embossed or that a plastic material is subjected to injection molding.

The substrate 301 may be a substrate using an inorganic material or a substrate using a composite material of an organic material and an inorganic material. Examples of the substrate using an inorganic material are a metal substrate, metal foil, and the like. Examples of the substrate using a composite material of an organic material and an inorganic material are a lamination of a resin substrate and an inorganic material, fiberglass-reinforced plastics (FRP), a prepreg, and the like.

When light emitted from the light-emitting element 310 is extracted through the substrate 301 side, a material that transmits light emitted from the light-emitting element 310 is used for the substrate 301.

Barrier Layer

One side of the substrate 301 is preferably provided with the barrier layer (the layer indicated by the dashed line in FIG. 3B) in order that impurities from the substrate 301 side be less dispersed into the light-emitting element 310. The barrier layer may be a layer including an inorganic material or a layer including a composite material of an organic material and an inorganic material. Examples of the inorganic material include nitrides, oxides, and metals, such as silicon nitride, silicon oxynitride, silicon oxide, aluminum oxide, aluminum, and silver. In addition, examples of the composite material of an organic material and an inorganic material are a layer in which a layer including the above inorganic material and a resin layer are alternately stacked and the like, for which an acrylic resin, a polyester resin, an epoxy resin, a vinyl chloride resin, polyvinyl alcohol, or the like can be used.

Light-Emitting Element

The light-emitting element 310 includes the first electrode over the barrier layer, the second electrode over the first electrode, and the layer including a light-emitting organic compound between the first and second electrodes. Although not illustrated, a partition that has an opening over the first electrode and covers an edge portion of the first electrode is preferably provided to prevent a short-circuit between the first and second electrodes.

The layer including a light-emitting organic compound and the second electrode, which are formed along a surface of the substrate 301 having a three-dimensional curved surface, are formed using the film formation apparatus of one embodiment of the present invention. Further, the layer including a light-emitting organic compound and the second electrode are formed by the method of forming a deposited film to cover a three-dimensional curved surface in accordance with one embodiment of the present invention.

A structure of the light-emitting element which can be used for the light-emitting device exemplified in this embodiment is detailed in Embodiment 6.

Sealing Material

The sealing material 302 exemplified in this embodiment has a three-dimensional curved surface. The sealing material 302 having a three-dimensional curved surface may be formed in such a way that, for example, a metal substrate is embossed or that a plastic material is subjected to injection molding.

The sealing material 302 may be a substrate using an inorganic material or a substrate using a composite material of an organic material and an inorganic material. Examples of a substrate using an inorganic material are a metal substrate, metal foil, and the like. Examples of a substrate using a composite material of an organic material and an inorganic material are a lamination of a resin substrate and an inorganic material, fiberglass-reinforced plastics (FRP), a prepreg, and the like.

As a material of the sealing material 302, a film serving as a barrier to impurities that lower the reliability of the light-emitting element 310 can be used. The film serving as a barrier can be formed using, for example, the film formation apparatus and the film formation method in accordance with one embodiment of the present invention or a chemical vapor deposition (CVD) method.

When light emitted from the light-emitting element 310 is extracted through the sealing material 302 side, a material that transmits light emitted from the light-emitting element 310 is used for the sealing material 302.

Method of Separating Light-Emitting Device

The plurality of light-emitting devices 300 exemplified in this embodiment can be formed using one substrate, although one of the light-emitting devices 300 may be formed using one substrate. As illustrated in FIG. 3C, the plurality of light-emitting devices 300 formed over the same substrate can be separated from each other using a laser (as indicated by the broken-line arrows). The use of a laser for the separation of the light-emitting devices allows the substrate having a three-dimensional curved surface to avoid contact with an edged tool or the like. It is thus possible to prevent, for example, collision of the substrate having a three-dimensional curved surface with a fixture of an edged tool or the like which might damage the light-emitting device 300. Further, by involving no such contact, even the light-emitting device 300 having a complicated shape can be easily separated.

This embodiment can be combined as appropriate with any of the other embodiments described in this specification.

Embodiment 6

This embodiment exemplifies structures of a light-emitting element which can be formed using a film formation apparatus and a film formation method in accordance with one embodiment of the present invention, with reference to FIGS. 4A to 4E.

The light-emitting element exemplified in this embodiment includes a first electrode, a second electrode, and a layer including a light-emitting organic compound (also referred to as an EL layer) between the first and second electrodes. One of the first and second electrodes serves as an anode, and the other serves as a cathode. The EL layer is provided between the first and second electrodes, and a structure of the EL layer may be as appropriate selected in accordance with materials of the first electrode and second electrode. Examples of the structure of the light-emitting element are described below; it is needless to say that the structure of the light-emitting element is not limited to this examples.

Structure Example 1 of Light-Emitting Element

Figure 4A:
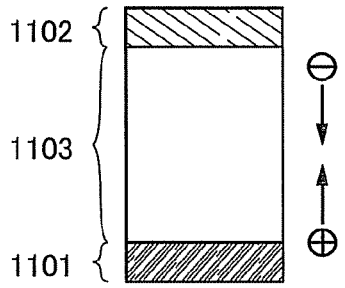
FIGS. 4A to 4E each illustrate a structure of a light-emitting element which can be used for a light-emitting device in accordance with one embodiment.

An example of the structure of the light-emitting element is illustrated in FIG. 4A. In the light-emitting element illustrated in FIG. 4A, the EL layer is provided between an anode 1101 and a cathode 1102.

Upon application of a voltage higher than the threshold voltage of the light-emitting element between the anode 1101 and the cathode 1102, holes are injected to the EL layer from the anode 1101 side and electrons are injected to the EL layer from the cathode 1102 side. The injected electrons and holes recombine in the EL layer, so that a light-emitting substance contained in the EL layer emits light.

In this specification, a layer or a stack which includes one region where electrons and holes injected from both ends recombine is referred to as a light-emitting unit. Hence, Structure Example 1 of the light-emitting element includes one light-emitting unit.

A light-emitting unit 1103 may include at least one light-emitting layer including a light-emitting substance, and may have a structure in which the light-emitting layer and a layer other than the light-emitting layer are stacked. Examples of the layer other than the light-emitting layer include layers containing a substance having a high hole-injection property, a substance having a high hole-transport property, a substance having a poor hole-transport property (a substance which blocks holes), a substance having a high electron-transport property, a substance having a high electron-injection property, and a substance having a bipolar property (a substance having high electron- and hole-transport properties).

Figure 4B:
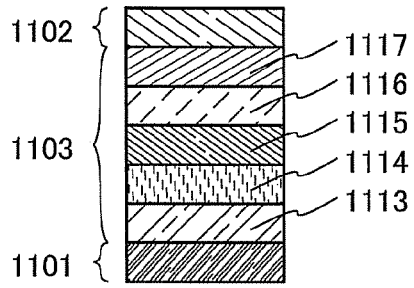

An example of a specific structure of the light-emitting unit 1103 is illustrated in FIG. 4B. In the light-emitting unit 1103 illustrated in FIG. 4B, a hole-injection layer 1113, a hole-transport layer 1114, a light-emitting layer 1115, an electron-transport layer 1116, and an electron-injection layer 1117 are stacked hi that order from the anode 1101 side.

Structure Example 2 of Light-Emitting Element

Figure 4C:
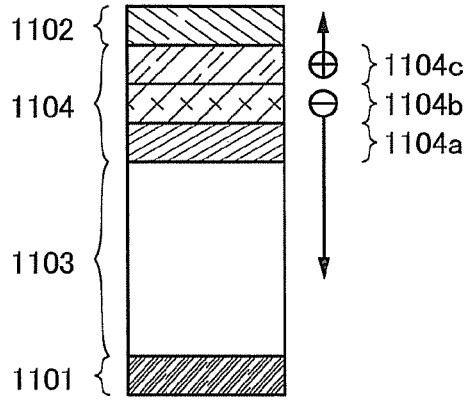

Another example of the structure of the light-emitting element is illustrated in FIG. 4C. In the light-emitting element illustrated in FIG. 4C, an EL layer including the light-emitting unit 1103 is provided between the anode 1101 and the cathode 1102. Further, an intermediate layer 1104 is provided between the cathode 1102 and the light-emitting unit 1103. Note that a structure similar to that of the light-emitting unit included in Structure Example 1 of the light-emitting element, which is described above, can be applied to the light-emitting unit 1103 in Structure Example 2 of the light-emitting element and that the description of Structure Example 1 of the light-emitting element can be referred to for the details.

The intermediate layer 1104 includes at least a charge generation region, and may have a structure in which the charge generation region and a layer other than the charge generation region are stacked. For example, a structure can be employed in which a first charge generation region 1104*c*, an electron-relay layer 1104*b*, and an electron-injection buffer 1104*a* are stacked in that order from the cathode 1102 side.

The behavior of electrons and holes in the intermediate layer 1104 is described. When a voltage higher than the threshold voltage of the light-emitting element is applied between the anode 1101 and the cathode 1102, in the first charge generation region 1104*c*, holes and electrons are generated, and the holes are transferred to the cathode 1102 and the electrons are transferred to the electron-relay layer 1104*b*. The electron-relay layer 1104*b* has a high electron-transport property and immediately transfers the electrons generated in the first charge generation region 1104*c* to the electron-injection buffer 1104*a*. The electron-injection buffer 1104*a* can reduce a barrier against electron injection into the light-emitting unit 1103, so that the efficiency of the electron injection into the light-emitting unit 1103 can be improved. Thus, the electrons generated in the first charge generation region 1104*c* are injected into the LUMO level of the light-emitting unit 1103 through the electron-relay layer 1104*b* and the electron-injection buffer 1104*a*.

In addition, the electron-relay layer 1104*b* can prevent interaction in which, for example, a substance included in the first charge generation region 1104*c* and a substance included in the electron-injection buffer 1104*a* react with each other at the interface thereof to impair the functions of the first charge generation region 1104*c* and the electron-injection buffer 1104*a*.

The range of choices of materials that can be used for the cathode in Structure Example 2 of the light-emitting element is wider than that of materials that can be used for the cathode in Structure Example 1. This is because a material having a relatively high work function can be used for the cathode in Structure Example 2 as long as the cathode can receive holes generated by the intermediate layer.

Structure Example 3 of Light-Emitting Element

Figure 4D:
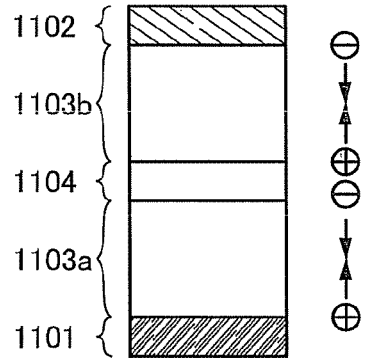
Figure 4E:
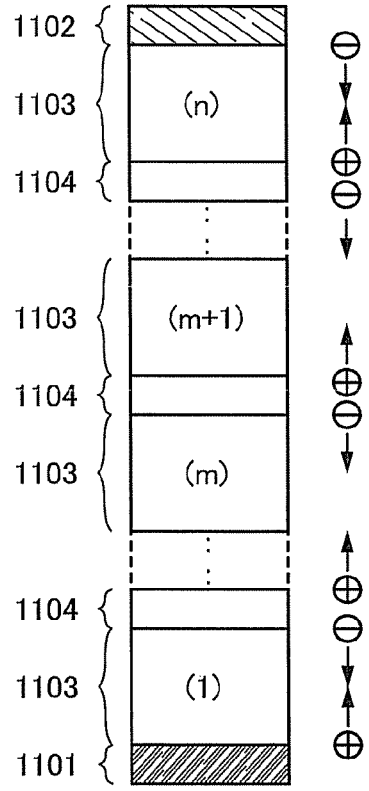

Another example of the structure of the light-emitting element is illustrated in FIG. 4D. In the light-emitting element illustrated in FIG. 4D, an EL layer including two light-emitting units is provided between the anode 1101 and the cathode 1102. Furthermore, the intermediate layer 1104 is provided between a first light-emitting unit 1103*a* and a second light-emitting unit 1103*b*.

Note that the number of the light-emitting units provided between the anode and the cathode is not limited to two. A light-emitting element illustrated in FIG. 4E has a structure in which a plurality of light-emitting units 1103 is stacked, that is, a so-called tandem structure. Note that in the case where n (n is a natural number greater than or equal to 2) light-emitting units 1103 are provided between the anode and the cathode, for example, the intermediate layer 1104 is provided between an mth (m is a natural number greater than or equal to 1 and less than or equal to n−1) light-emitting unit and an (m+1)th light-emitting unit.

Note that a structure similar to that in Structure Example 1 of the light-emitting element can be applied to the light-emitting unit 1103 in Structure Example 3 of the light-emitting element; a structure similar to that in Structure Example 2 of the light-emitting element can be applied to the intermediate layer 1104 in Structure Example 3 of the light-emitting element. Thus, for the details, the description of the Structure Example 1 of the light-emitting element or the Structure Example 2 of the light-emitting element can be referred to.

The behavior of electrons and holes in the intermediate layer 1104 provided between the light-emitting units is described. Upon application of a voltage higher than the threshold voltage of the light-emitting element between the anode 1101 and the cathode 1102, holes and electrons are generated in the intermediate layer 1104, and the holes are transferred to the light-emitting unit provided on the cathode 1102 side and the electrons are transferred to the light-emitting unit provided on the anode side. The holes injected into the light-emitting unit provided on the cathode side recombine with the electrons injected from the cathode side, so that a light-emitting substance contained in the light-emitting unit emits light. The electrons injected into the light-emitting unit provided on the anode side recombine with the holes injected from the anode side, so that a light-emitting substance contained in the light-emitting unit emits light. Thus, the holes and electrons generated in the intermediate layer 1104 cause light emission in the respective light-emitting units.

Note that in the case where a structure which is the same as the intermediate layer is formed between the light-emitting units by providing the light-emitting units in contact with each other, the light-emitting units can be formed to be in contact with each other. Specifically, when one surface of the light-emitting unit is provided with a charge generation region, the charge generation region functions as a first charge generation region of the intermediate layer; thus, the light-emitting units can be provided in contact with each other.

The Structure Examples 1 to 3 of the light-emitting element can be implemented in combination. For example, an intermediate layer can be provided between the cathode and a light-emitting unit in Structure Example 3 of the light-emitting element.

Material which can be Used for Light-Emitting Element

Next, specific materials that can be used for the light-emitting element having the above-described structure are described. Materials for the anode, the cathode, and the EL layer are described in that order.

Material which can be Used for Anode

The anode 1101 is formed with a single-layer structure or a stacked structure using any of a metal, an alloy, an electrically conductive compound, and a mixture thereof which have conductivity. In particular, a structure in which a material with a high work function (specifically, 4.0 eV or more) is in contact with the EL layer is preferable.

Examples of the metal or the alloy material are metal materials such as gold (Au), platinum (Pt), nickel (Ni), tungsten (W), chromium (Cr), molybdenum (Mo), iron (Fe), cobalt (Co), copper (Cu), palladium (Pd), and titanium (Ti) and alloy materials thereof.

Examples of the electrically conductive compound are an oxide of a metal material, a nitride of a metal material, and an electrically conductive high molecule.

Specific examples of the oxide of a metal material are indium tin oxide (ITO), indium tin oxide containing silicon or silicon oxide, indium tin oxide containing titanium, indium titanium oxide, indium tungsten oxide, indium zinc oxide, indium zinc oxide containing tungsten, and the like. Other examples of the oxide of a metal material are molybdenum oxide, vanadium oxide, ruthenium oxide, tungsten oxide, manganese oxide, titanium oxide, and the like.

A film containing the oxide of a metal material is usually deposited by a sputtering method, but may also be formed by application of a sol-gel method or the like. For example, an indium-zinc oxide film can be formed by a sputtering method using a target in which zinc oxide is added at greater than or equal to 1 wt % and less than or equal to 20 wt % to indium oxide. A film of indium oxide containing tungsten oxide and zinc oxide can be formed by a sputtering method using a target in which tungsten oxide and zinc oxide are added at greater than or equal to 0.5 wt % and less than or equal to 5 wt % and greater than or equal to 0.1 wt % and less than or equal to 1 wt %, respectively, to indium oxide.

Specific examples of the nitride of a metal material are titanium nitride, tantalum nitride, and the like.

Specific examples of the electrically conductive high molecule are poly(3,4-ethylenedioxythiophene)/poly(styrenesulfonic acid) (PEDOT/PSS), polyaniline/poly(styrenesulfonic acid) (PAni/PSS), and the like.

Note that in the case where a second charge generation region is provided in contact with the anode 1101, a variety of electrically conductive materials can be used for the anode 1101 regardless of the magnitude of their work functions. Specifically, besides a material which has a high work function, a material which has a low work function can also be used. A material for forming the second charge generation region is described later together with a material for foaming the first charge generation region.

Material which can be Used for Cathode

In the case where the first charge generation region 1104*c* is provided between the cathode 1102 and the light-emitting unit 1103 to be in contact with the cathode 1102, a variety of electrically conductive materials can be used for the cathode 1102 regardless of their work functions.

Note that at least one of the cathode 1102 and the anode 1101 is fainted using an electrically conductive film that transmits visible light. For example, when one of the cathode 1102 and the anode 1101 is formed using an electrically conductive film that transmits visible light and the other is formed using an electrically conductive film that reflects visible light, a light-emitting element that emits light from one side can be formed. Alternatively, when both the cathode 1102 and the anode 1101 are formed using electrically conductive films that transmit visible light, a light-emitting element that emits light from both sides can be formed.

Examples of the electrically conductive film that transmits visible light are a film of indium tin oxide, a film of indium tin oxide containing silicon or silicon oxide, a film of indium tin oxide containing titanium, a film of indium titanium oxide, a film of indium tungsten oxide, a film of indium zinc oxide, and a film of indium zinc oxide containing tungsten. Further, a metal thin film having a thickness enough to transmit light (preferably, approximately greater than or equal to 5 nm and less than or equal to 30 nm) can also be used.

For the electrically conductive film that reflects visible light, a metal is used, for example. Specific examples thereof are metal materials such as silver, aluminum, platinum, gold, and copper, and an alloy material containing any of these. Examples of the alloy containing silver are a silver-neodymium alloy, a magnesium-silver alloy, and the like. Examples of the alloy of aluminum are an aluminum-nickel-lanthanum alloy, an aluminum-titanium alloy, an aluminum-neodymium alloy, and the like.

Material which can be Used for EL Layer

Specific examples of materials for the above-described layers included in the light-emitting unit 1103 are given below.

The hole-injection layer is a layer including a substance having a high hole-injection property. As the substance having a high hole-injection property, for example, molybdenum oxide, vanadium oxide, ruthenium oxide, tungsten oxide, manganese oxide, or the like can be used. In addition, it is possible to use a phthalocyanine-based compound such as phthalocyanine (abbreviation: $H_2Pc$) or copper phthalocyanine (abbreviation: CuPc), a high molecule such as poly(3,4-ethylenedioxythiophene)/poly(styrenesulfonic acid) (PEDOT/PSS), or the like to form the hole-injection layer.

Note that the hole-injection layer may be formed using the second charge generation region. When the second charge generation region is used for the hole-injection layer, a variety of electrically conductive materials can be used for the anode 1101 regardless of their work functions as described above. A material for forming the second charge generation region is described later together with a material for forming the first charge generation region.

Hole-Transport Layer

The hole-transport layer is a layer including a substance having a high hole-transport property. The hole-transport layer is not limited to a single layer, and may be a stack of two or more layers each containing a substance having a high hole-transport property. The hole-transport layer contains a substance having a higher hole-transport property than an electron-transport property, and preferably contains a substance having a hole mobility higher than or equal to $10^{-6}$ $cm^2/Vs$ because the driving voltage of the light-emitting element can be reduced.

Examples of the substance having a high hole-transport property are aromatic amine compounds (e.g., 4,4'-bis[N-(1-naphthyl)-N-phenylamino]biphenyl (abbreviation: NPB or α-NPD), carbazole derivatives (e.g., 9-[4-(10-phenyl-9-anthracenyl)phenyl ]-9H-carbazole (abbreviation: CzPA)), and the like. Alternatively, a high molecular compound (e.g., poly (N-vinylcarbazole) (abbreviation: PVK)), or the like can be used.

Light-Emitting Layer

The light-emitting layer is a layer including a light-emitting substance. The light-emitting layer is not limited to a single layer, but may be a stack of two or more layers containing light-emitting substances. As the light-emitting substance, a fluorescent compound or a phosphorescent compound can be used. As the light-emitting substance, a phosphorescent compound is preferably used, in which case the emission efficiency of the light-emitting element can be enhanced.

As the light-emitting substance, a fluorescent compound (e.g., coumarin 545T) or a phosphorescent compound (e.g., tris(2-phenylpyridinato)iridium(III) (abbreviation: $Ir(ppy)_3$)) can be used.

The light-emitting substance is preferably dispersed in a host material. The host material preferably has higher excitation energy than the light-emitting substance.

As the material which can be used as the host material, the above-mentioned substance having a high hole-transport property (e.g., an aromatic amine compound, a carbazole derivative, and a high molecular compound), a substance having a high electron-transport property (e.g., a metal complex having a quinoline skeleton or a benzoquinoline skeleton and a metal complex having an oxazole-based ligand or a thiazole-based ligand), which will be described later, or the like can be used.

Electron-Transport Layer

The electron-transport layer is a layer including a substance having a high electron-transport property. The electron-transport layer is not limited to a single layer, and may be a stack of two or more layers each containing a substance having a high electron-transport property. The electron-transport layer contains a substance having a higher electron-transport property than a hole-transport property, and preferably contains a substance having an electron mobility higher than or equal to $10^{-6}$ $cm^2/V\cdot s$, in which case the driving voltage of the light-emitting element can be reduced.

Examples of the substance having a high electron-transport property include a metal complex having a quinoline skeleton or a benzoquinoline skeleton (e.g., tris(8-quinolinolato)aluminum (abbreviation: Alq)), a metal complex having an oxazole-based or thiazole-based ligand (e.g., bis[2-(2-hydroxyphenyl)benzoxazolato]zinc (abbreviation: $Zn(BOX)_2$)), and other compounds (e.g., bathophenanthroline (abbreviation: BPhen)). Alternatively, a high molecular compound (e.g., poly[(9,9-dihexylfluorene-2,7-diyl)-co-(pyridine-3,5-diyl)] (abbreviation: PF-Py)) or the like can be used.

Electron-Injection Layer

The electron-injection layer is a layer including a substance having a high electron-injection property. The electron-injection layer is not limited to a single layer, and may be a stack of two or more layers containing substances having a high electron-injection property. The electron-injection layer is preferably provided because the efficiency of electron injection from the cathode 1102 can be increased and the driving voltage of the light-emitting element can be reduced.

Examples of the substance having a high electron-injection property are an alkali metal (e.g., lithium (Li), or cesium (Cs)), an alkaline earth metal (e.g., calcium (Ca)), a compound of such a metal (e.g., oxide (specifically, lithium oxide, or the like), a carbonate (specifically, lithium carbonate, cesium carbonate, or the like), a halide (specifically, lithium fluoride (LiF), cesium fluoride (CsF), or calcium fluoride ($CaF_2$)), and the like.

Alternatively, the layer including the substance having a high electron-injection property may be a layer including a substance having a high electron-transport property and a donor substance (specifically, a layer made of Alq containing magnesium (Mg)). Note that the donor substance is preferably added so that the mass ratio of the donor substance to the substance having a high electron-transport property is greater than or equal to 0.001:1 and less than or equal to 0.1:1.

As the donor substance, an alkali metal, an alkaline earth metal, a rare earth metal, a compound of any of these metals, an organic compound such as tetrathianaphthacene (abbreviation: TTN), nickelocene, or decamethylnickelocene can be used.

Material which can be Used for Charge Generation Region

The first charge generation region 1104*c* and the second charge generation region are regions containing a substance having a high hole-transport property and an acceptor substance. The charge generation region may not only include a substance having a high hole-transport property and an acceptor substance in the same film but may include a stack of a layer including a substance having a high hole-transport property and a layer including an acceptor substance. Note that in the case where the first charge generation region provided on the cathode side has a stacked structure, the layer including the substance having a high hole-transport property is in contact with the cathode 1102. In the case where the second charge generation region provided on the anode side has a stacked structure, the layer including the acceptor substance is in contact with the anode 1101.

Note that the acceptor substance is preferably added to the charge generation region so that the mass ratio of the acceptor substance to the substance having a high hole-transport property is greater than or equal to 0.1:1 and less than or equal to 4.0:1.

Examples of the acceptor substance that is used for the charge generation region are a transition metal oxide and an oxide of a metal belonging to Group 4 to Group 8 of the periodic table. Specifically, molybdenum oxide is particularly preferable. Note that molybdenum oxide has a low hygroscopic property.

As the substance having a high hole-transport property used for the charge generation region, any of a variety of organic compounds such as an aromatic amine compound, a carbazole derivative, an aromatic hydrocarbon, and a high molecular compound (e.g., an oligomer, a dendrimer, or a polymer) can be used. Specifically, a substance having a hole mobility higher than or equal to $10^{-6}$ $cm^2/Vs$ is preferably used. Note that other than the above substances, any substance that has a property of transporting more holes than electrons may be used.

Material which can be Used for Electron-Relay Layer

The electron-relay layer 1104*b* is a layer that can immediately receive electrons drawn out by the acceptor substance in the first charge generation region, 1104*c*. Hence, the electron-relay layer 1104*b* is a layer including a substance having a high electron-transport property. Its LUMO level is positioned between the acceptor level of the acceptor substance in the first charge generation region 1104*c* and the LUMO level of the light-emitting unit 1103 in contact with the electron-relay layer. Specifically, the LUMO level of the electron-relay layer 1104*b* is preferably higher than or equal to −5.0 eV and lower than or equal to −3.0 eV.

Examples of the substance used for the electron-relay layer 1104*b* are a perylene derivative (e.g., 3,4,9,10-perylenetetracarboxylic dianhydride (abbreviation: PTCDA)), a nitrogen-containing condensed aromatic compound (pirazino[2,3-f][1,10]phenanthroline-2,3-dicarbonitrile (abbreviation: PPM)), and the like.

Note that a nitrogen-containing condensed aromatic compound is preferably used for the electron-relay layer 1104*b* because of its stability. Among nitrogen-containing condensed aromatic compounds, a compound having an electron-withdrawing group such as a cyano group or a fluoro group is preferably used because such a compound further facilitates acceptance of electrons in the electron-relay layer 1104*b*.

Material which can be Used for Electron-Injection Buffer

An electron-injection buffer is a layer including a substance having a high electron-injection property. The electron-injection buffer 1104*a* is a layer that facilitates electron injection from the first charge generation region 1104*c* into the light-emitting unit 1103. By providing the electron-injection buffer 1104*a* between the first charge generation region 1104*c* and the light-emitting unit 1103, the injection barrier therebetween can be reduced.

Examples of the substance having a high electron-injection property are an alkali metal, an alkaline earth metal, a rare earth metal, a compound of any of these metals, and the like.

Further, the layer including a substance having a high electron-injection property may be a layer including a substance having a high electron-transport property and a donor substance.

Method of Manufacturing Light-Emitting Element

One mode of a method of manufacturing a light-emitting element is described. Over the first electrode, the layers described above are combined as appropriate to form the EL layer. Any of a variety of methods (e.g., a dry process or a wet process) can be used to form the EL layer depending on the material for the EL layer. For example, a vacuum evaporation method, a transfer method, a printing method, an inkjet method, a spin coating method, or the like may be selected. Note that different formation methods may be employed for the layers. The second electrode is formed over the EL layer. In the above manner, the light-emitting element is manufactured.

The light-emitting element described in this embodiment can be manufactured by combination of the above-described materials. With this light-emitting element, light emission from the above-described light-emitting substance can be obtained. The emission color can be selected by changing the type of the light-emitting substance.

Further, a plurality of light-emitting substances which emit light of different colors can be used, whereby, for example, white light emission can also be obtained by expanding the width of the emission spectrum. Note that in order to obtain white light emission, for example, a structure may be employed in which at least two layers containing light-emitting substances are provided so that light of complementary colors is emitted. Specific examples of complementary colors are "blue and yellow", "blue-green and red", and the like.

Further, in order to obtain white light emission with an excellent color rendering property, an emission spectrum preferably spreads through the entire visible light region. For example, a light-emitting element may include layers emitting light of blue, green, and red.

This embodiment can be combined as appropriate with any of the other embodiments described in this specification.

Embodiment 7

Figure 5A:
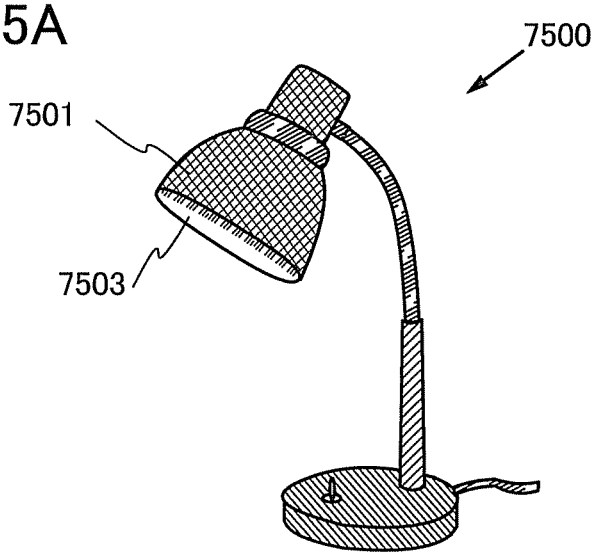
FIGS. 5A and 5B illustrate structures of lighting devices each using a light-emitting device in accordance with one embodiment.
Figure 5B:
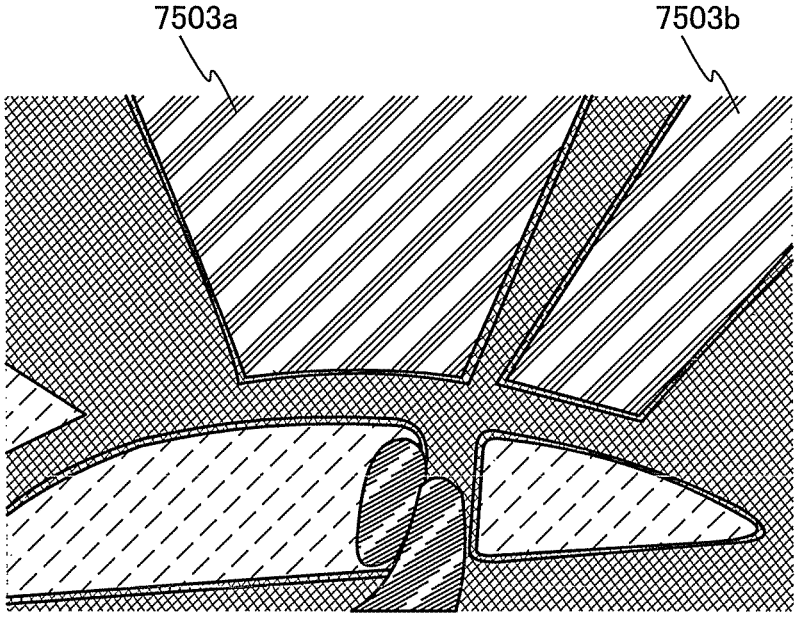

This embodiment exemplifies a lighting device using a light-emitting device including a deposited film to cover a three-dimensional curved surface formed using a film formation apparatus and a film formation method in accordance with one embodiment of the present invention, with reference to FIGS. 5A and 5B. The light-emitting device including a three-dimensional curved surface is placed in a housing having a three-dimensional curved surface, thereby achieving a lighting device having a three-dimensional curved surface.

FIG. 5A illustrates an example of the lighting device. In a lighting device 7500, a light-emitting device 7503 of one embodiment of the present invention is incorporated as a light source in a housing 7501. The lighting device 7500 can be used as a desk lamp.

FIG. 5B illustrates an example of the lighting device having a three-dimensional curved surface, which is to be provided on the ceiling of an automobile. Since a light-emitting device 7503*a* and a light-emitting device 7503*b* each have a three-dimensional curved surface, they can be used by being attached to a base having a three-dimensional curved surface. Note that the light-emitting devices can also be used for a ceiling having a three-dimensional curved surface on a train, a plane, etc.

This embodiment can be combined as appropriate with any of the other embodiments described in this specification.

This application is based on Japanese Patent Application serial no. 2011-280793 filed with the Japan Patent Office on Dec. 22, 2011, the entire contents of which are hereby incorporated by reference.

What is claimed is:

1. A film formation method comprising the steps of:

placing a deposition source to face a three-dimensional curved surface of a deposition object;

adjusting a first angle formed between a deposition direction of the deposition source and a normal direction of a first region of the three-dimensional curved surface by changing the deposition direction of the deposition source;

performing a first deposition to the first region while moving the deposition source so as to form a first layer;

after performing the first deposition, adjusting a second angle formed between the deposition direction of the deposition source and a normal direction of a second region of the three-dimensional curved surface by changing the deposition direction of the deposition source; and performing a second deposition to the second region while moving the deposition source so as to form a second layer, wherein the first angle is maintained substantially constant during the step of performing the first deposition, wherein the second angle is maintained substantially constant during the step of performing the second deposition, and wherein the first angle and the second angle is substantially same.

2. The film formation method according to claim 1, wherein the first layer and the second layer are rectangle layers.

3. The film formation method according to claim 1, wherein a distance between the deposition source and the first region is maintained substantially constant during the step of performing the first deposition.

4. The film formation method according to claim 1, wherein, the first angle and the second angle are substantially right angles.

5. The film formation method according to claim 1, wherein the first angle is adjusted by changing the deposition direction of the deposition source and changing a holding angle of the three-dimensional curved surface of the deposition object.

6. A film formation method comprising the steps of:

placing a deposition source to face a three-dimensional curved surface of a deposition object;

adjusting a first angle formed between a deposition direction of the deposition source and a normal direction of a first region of the three-dimensional curved surface by changing the deposition direction of the deposition source;

performing a first deposition to the first region while moving the deposition source at a first speed, so as to form a first layer;

after the performing the first deposition, adjusting a second angle formed between the deposition direction of the deposition source and a normal direction of a second region of the three-dimensional curved surface by changing the deposition direction of the deposition source; and performing a second deposition to the second region while moving the deposition source at a second speed lower than the first speed, so as to form a second layer, wherein the first angle is maintained substantially constant during the step of performing the first deposition, wherein the second angle is maintained substantially constant during the step of performing the second deposition; and wherein the first angle is closer to 90° than the second angle.

7. The film formation method according to claim 6, wherein the first layer and the second layer are rectangle layers.

8. The film formation method according to claim 6, wherein a distance between the deposition source and the first region is maintained substantially constant during the step of performing the first deposition.

9. The film formation method according to claim 6, wherein the first angle is adjusted by changing the deposition direction of the deposition source and changing a holding angle of the three-dimensional curved surface of the deposition object.

* * * * *